US011830694B2

(12) United States Patent
Yoo

(10) Patent No.: US 11,830,694 B2
(45) Date of Patent: Nov. 28, 2023

(54) DIRECT CURRENT RELAY

(71) Applicant: LS ELECTRIC CO., LTD., Anyang-si (KR)

(72) Inventor: Jungwoo Yoo, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 17/269,476

(22) PCT Filed: Aug. 6, 2019

(86) PCT No.: PCT/KR2019/009758
§ 371 (c)(1),
(2) Date: Feb. 18, 2021

(87) PCT Pub. No.: WO2020/045844
PCT Pub. Date: Mar. 5, 2020

(65) Prior Publication Data

US 2021/0313133 A1 Oct. 7, 2021

(30) Foreign Application Priority Data

Aug. 31, 2018 (KR) ..... 10-2018-0103713

(51) Int. Cl.
*H01H 3/00* (2006.01)
*H01H 50/56* (2006.01)
*H01H 50/44* (2006.01)

(52) U.S. Cl.
CPC ..... *H01H 50/56* (2013.01); *H01H 50/44* (2013.01)

(58) Field of Classification Search
CPC ..... H01H 1/20; H01H 47/002; H01H 50/023; H01H 71/04; H01H 2071/048;
(Continued)

(56) References Cited

U.S. PATENT DOCUMENTS 4,513,270 A * 4/1985 Belbel ..... H01H 77/101 335/16
5,394,128 A * 2/1995 Perreira ..... H01H 51/06 335/154

(Continued)

FOREIGN PATENT DOCUMENTS

EP 3258476 A1 12/2017
JP 2015141893 A 8/2015

(Continued)

OTHER PUBLICATIONS

International Search Report of PCT/KR2019/009758, dated Nov. 19, 2019.

(Continued)

*Primary Examiner* — Shawki S Ismail
*Assistant Examiner* — Lisa N Homza
(74) *Attorney, Agent, or Firm* — K&L Gates LLP

(57) ABSTRACT

The present disclosure relates to a direct current relay and, more particularly, to a direct current relay including a mover assembly having improved support force with respect to a movable contactor. The direct current relay according to an embodiment of the present disclosure comprises a pair of fixed contactors and a movable contactor which is moved up and down by an actuator to come into contact with or be separated from the pair of fixed contactors, comprises a mover support disposed below the movable contactor and connected to the actuator by a shaft; a mover holder disposed above the movable contactor and fixed to the mover support; a contact pressure spring disposed between the movable contactor and the mover support to provide a contact pressure to the movable contactor; and a supporting pin installed to extend through the movable contactor and the mover holder.

8 Claims, 7 Drawing Sheets

(58) Field of Classification Search
CPC ..... H01H 2050/025; H01H 2071/042; H01H 50/56; H01H 50/44
USPC ..... 335/185
See application file for complete search history.

(56) References Cited

U.S. PATENT DOCUMENTS 5,892,194 A * 4/1999 Uotome ..... H01H 51/065 335/154
8,228,149 B2 * 7/2012 Puth ..... H01F 7/1615 335/229
8,269,585 B2 * 9/2012 Choi ..... H01H 1/2008 335/196
8,653,917 B2 * 2/2014 Takaya ..... H01H 9/443 335/131
9,613,771 B2 * 4/2017 Lim ..... H01H 1/54
2006/0050466 A1 * 3/2006 Enomoto ..... H01H 50/02 361/160
2009/0322454 A1 * 12/2009 Tanaka ..... H01H 50/38 335/189
2009/0322455 A1 * 12/2009 Yoshihara ..... H01H 50/36 335/189
2011/0032059 A1 * 2/2011 Ito ..... H01H 50/14 218/25
2011/0221548 A1 * 9/2011 Yoshihara ..... H01H 51/29 335/185
2013/0057369 A1 * 3/2013 Yano ..... H01H 51/00 335/156
2014/0014622 A1 * 1/2014 Naka ..... H01H 50/163 218/4
2015/0015350 A1 * 1/2015 Tachikawa ..... H01H 50/58 335/131
2015/0022291 A1 * 1/2015 Kashimura ..... H01H 3/28 218/148
2015/0022292 A1 * 1/2015 Tachikawa ..... H01H 50/641 335/131
2015/0022296 A1 * 1/2015 Takaya ..... H01H 50/04 335/201
2015/0034600 A1 * 2/2015 Isozaki ..... H01H 1/06 218/148
2015/0187518 A1 * 7/2015 Molyneux ..... H01H 50/546 335/196
2015/0213985 A1 * 7/2015 Naka ..... H01H 50/648 335/189
2015/0213986 A1 * 7/2015 Naka ..... H01H 50/648 335/189
2015/0380145 A1 * 12/2015 Koch ..... H01F 7/1844 335/282
2016/0155592 A1 * 6/2016 Ito ..... H01H 50/60 335/187
2016/0260563 A1 * 9/2016 Shima ..... H01H 9/443
2016/0260566 A1 * 9/2016 Shima ..... H01H 50/54
2016/0300677 A1 * 10/2016 Park ..... H01H 9/443
2017/0110275 A1 * 4/2017 Yang ..... H01H 50/305
2018/0096811 A1 * 4/2018 Lee ..... H01H 50/026
2021/0175031 A1 * 6/2021 Yoo ..... H01H 50/60
2021/0193421 A1 * 6/2021 Yoo ..... H01H 50/36

FOREIGN PATENT DOCUMENTS

JP 2018-060768 A 4/2018
KR 19980033672 U 9/1998
KR 10-1006320 B1 1/2011
KR 10-1090501 B2 12/2011
KR 20160121961 A 10/2016
WO 2014005611 A1 1/2014
WO 2014208098 A1 12/2014
WO 2017217045 A1 12/2017

OTHER PUBLICATIONS

Japanese Notice of Allowance for related Japanese Application No. 2021-508300; action dated Apr. 26, 2022; (3 pages).
Extended European Search Report for related European Application No. 19856393.4; action dated May 6, 2022; (6 pages).

* cited by examiner

DIRECT CURRENT RELAY

CROSS-REFERENCE TO RELATED APPLICATIONS

This application is the National Stage filing under 35 U.S.C. 371 of International Application No. PCT/KR2019/009758, filed on Aug. 6, 2019, which claims the benefit of earlier filing date and right of priority to Korean Application No. 10-2018-0103713 filed on Aug. 31, 2018, the contents of which are all hereby incorporated by reference herein in their entirety.

TECHNICAL FIELD

The present disclosure relates to a direct current relay and, more particularly, to a direct current relay including a mover assembly having improved support force with respect to a movable contact.

BACKGROUND

In general, a direct current relay or a magnetic switch is a kind of electrical circuit switching device that allows mechanical operation and transmits current signal using principles of electromagnet, and is installed in various industrial facilities, machines, and vehicles.

In particular, electric vehicles such as hybrid vehicles, fuel cell vehicles, golf carts, and electric forklifts are equipped with an electric vehicle relay to supply and cut off power of a battery to a power generating device and an electrical equipment. And, such an electric vehicle relay is one of very important core components in electric vehicles.

FIG. 1 illustrates an internal structure of a direct current relay according to the related art.

The direct current relay includes a case 1, 2 including an upper frame 1 and a lower frame 2, a middle plate 9 provided inside the case, a contact portion 3, 4 and an arc-extinguishing portion 8 both installed above the middle plate 9, and an actuator 7 installed under the middle plate 9. Here, the actuator 7 may be a device that operates by the principles of electromagnet.

At an upper surface of the upper frame 1, a fixed contact 3 of the contact portion 3, 4 is exposed so as to be connected to a load or power source.

The contact portion 3, 4 and the arc-extinguishing portion 8 are provided inside the upper frame 1. The contact portion 3, 4 includes the fixed contact 3 fixedly installed in the upper frame 1, and a movable contact 4 actuated by the actuator 7 so as to be brought into contact with or separated from the fixed contact 3. The arc-extinguishing portion 8 is usually made of a ceramic material. The arc-extinguishing portion 8 is also referred to as an arc chamber. Inside the arc-extinguishing portion 8, there may be filled with extinguishing gas for arc extinguishing.

To effectively control an arc generated when the contact portion 3, 4 is cutoff (or separated), a permanent magnet (not illustrated) may be provided. The permanent magnet is installed around the contact portion to generate a magnetic field to control the arc, which is a rapid flow of electricity, and a permanent magnet holder 6 is provided to fix the permanent magnet.

The actuator is operated using the principles of electromagnet and includes a fixed core 7*a*, a movable core 7*b*, a movable shaft 7*c*, and a return spring 7*d*. A cylinder 7*e* surrounds the fixed core 7*a* and the movable core 7*b*. The cylinder 7*e* and the arc-extinguishing portion 8 form a closed space.

A coil 7*f* is provided around the cylinder 7*e*, and when a control power is applied, an electromagnetic force is generated around the cylinder 7*e*. The fixed core 7*a* is magnetized by the electromagnetic force generated by the coil 7*f*, and the movable core 7*b* is attracted by a magnetic force of the fixed core 7*a*. Accordingly, the movable shaft 7*c* coupled to the movable core 7*b* and the movable contact 4 coupled to an upper portion of the movable shaft 7*c* move together to be brought into contact with the fixed contact 3 so that the circuit is energized. The return spring 7*d* provides an elastic force to the movable core 7*b* to allow the movable core 7*b* to return to its initial position when the control power of the coil is cut off.

The movable contact 4 moves up and down with being connected to the movable shaft 7*c*. The movable contact 4 may be configured as a mover assembly. Here, the mover assembly may include the movable contact 4, a mover support 4*a*, a mover holder 4*b*, the movable shaft 7*c*, and a contact pressure spring 5. The mover support 4*a* and the mover holder 4*b* are formed in an injection molding manner together with the movable shaft 7*c* so that they are moved integrally. In this type of mover assembly, the mover support 4*a* and the mover holder 4*b* form a magnetic circuit to increase a contact pressure between the movable contact 4 and the fixed contact 3.

Meanwhile, an upper surface of the movable contact 4 is brought into contact with the mover holder 4*b*, and a lower surface of the movable contact 4 is supported by the contact pressure spring 5 by receiving a pressure of the contact pressure spring 5.

However, in the direct current relay according to the related art described above, since the movable contact 4 is fixed only by a support force of the contact pressure spring 5, there is a risk that the movable contact 4 may escape from the mover assembly when the force of the contact pressure spring 5 is weak or a strong external force is applied.

SUMMARY

The present disclosure is to solve those problems, and an aspect of the present disclosure is to provide a magnetic contactor provided with a mover assembly that improves support for a movable contact.

A direct current relay according to an embodiment of the present disclosure, including a pair of fixed contacts and a movable contact which is moved up and down by an actuator to come into contact with or be separated from the pair of fixed contacts, includes a mover support disposed below the movable contact and connected to the actuator by a shaft, a mover holder disposed above the movable contact and fixed to the mover support, a contact pressure spring disposed between the movable contact and the mover support to provide a contact pressure to the movable contact, and a supporting pin installed to extend through the movable contact and the mover holder.

Here, central portions of the movable contact and the mover holder are respectively provided with a fitting hole and a through hole through which the supporting pin is inserted.

In addition, a diameter of the fitting hole is smaller than a diameter of the supporting pin in a state in which no external force is applied.

In addition, a diameter of the through hole is larger than the diameter of the supporting pin.

In addition, the supporting pin is implemented as a leaf spring.

In addition, a cross section of the supporting pin is defined in a 'C' shape.

In addition, a lower surface of the movable contact is provided with a mover support portion to support the supporting pin.

In addition, an upper surface of the mover support is provided with a spring support portion protruding therefrom to support a lower end of the contact pressure spring.

In addition, the supporting pin protrudes outwardly of an upper portion of the mover holder.

In addition, an upper surface of the mover holder is provided with a support pipe portion extending upwardly to support the supporting pin.

In addition, at a lower end of the supporting pin, there is provided a support ring portion protruding in a ring shape along an outer circumferential surface of the supporting pin.

According to a direct current relay according to an embodiment of the present disclosure, a supporting pin configured to support a movable contact and a mover holder by connecting them together is provided to prevent escape of the movable contact.

In addition, since the supporting pin is implemented as a spring plate and may simply be inserted into the mover holder and the movable contact, the supporting pin is easy to be assembled.

DETAILED DESCRIPTION

Hereinafter, preferred embodiments of the present disclosure will be described with reference to the accompanying drawings, but this is to explain in detail enough for those skilled in the art to easily implement the disclosure, and it does not mean that the technical idea and scope of the disclosure are limited thereto.

Figure 1:
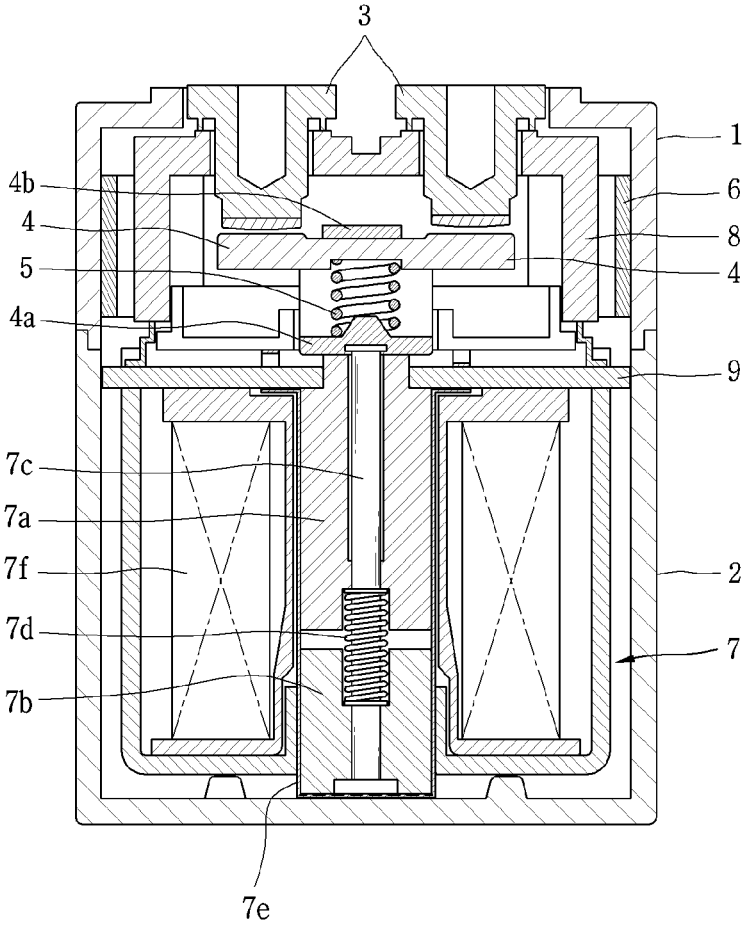
Fig. 1 Prior Art
FIG. 1 is a view of an internal structure of a direct current relay according to the related art.
Figure 2:
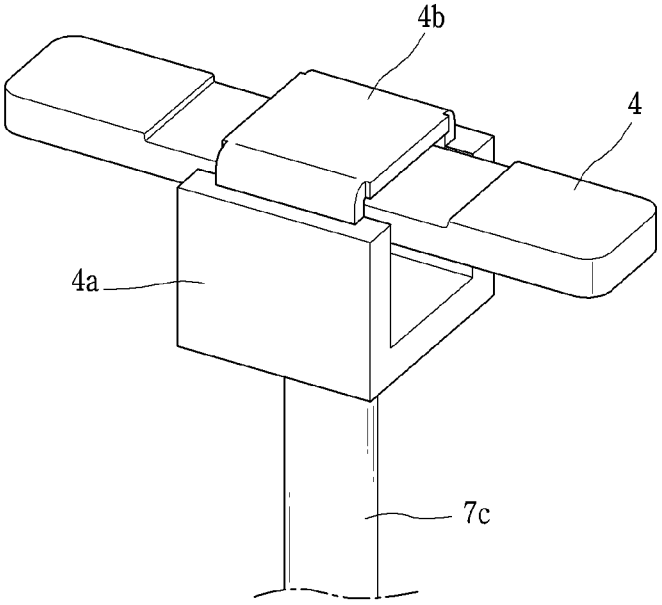
Fig. 2 Prior Art
FIG. 2 is a perspective view of a mover assembly in FIG. 1.
Figure 3:
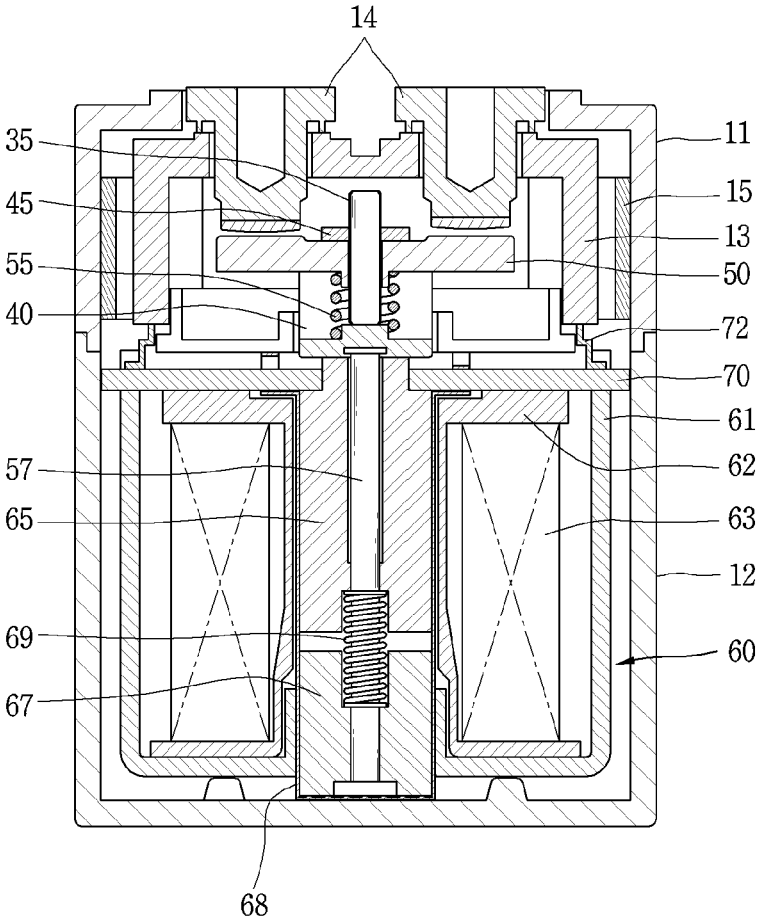
FIG. 3 is a view of an internal structure of a direct current relay according to an embodiment of the present disclosure.
Figure 4:
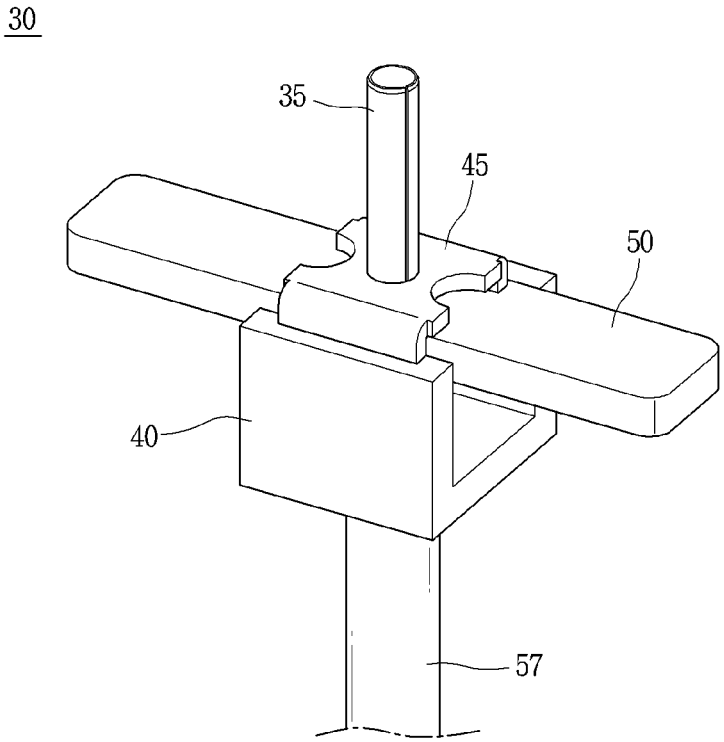
FIG. 4 is a perspective view of a mover assembly in FIG. 3.
Figure 5:
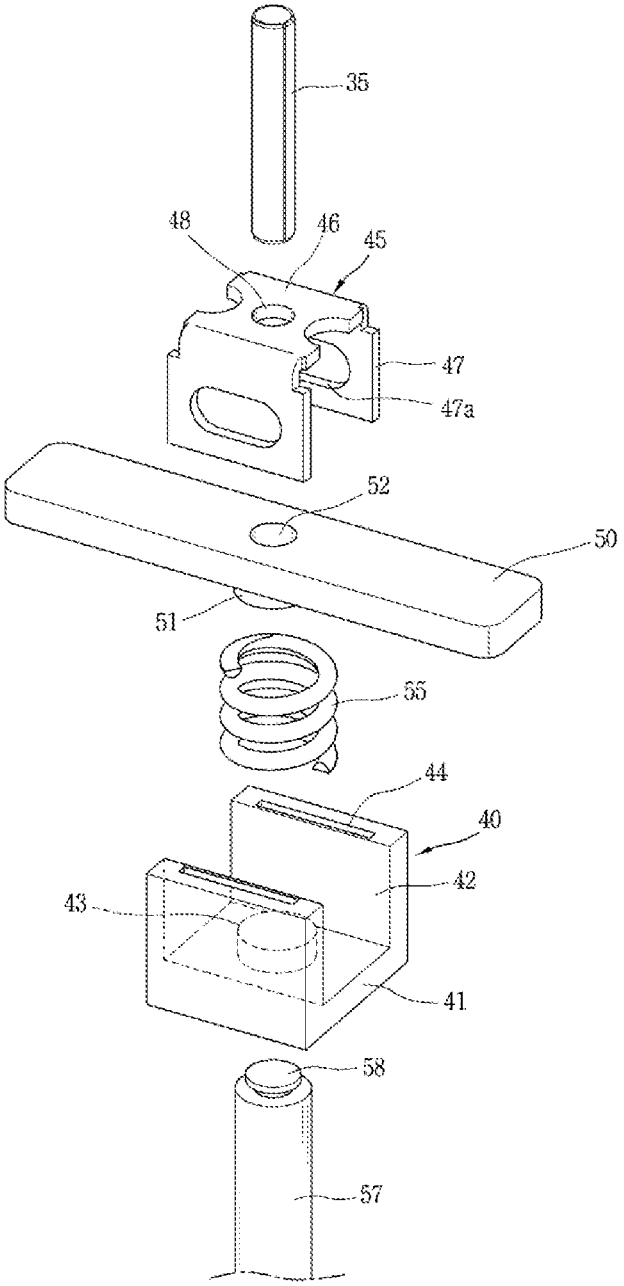
FIG. 5 is an exploded perspective view of the mover assembly of FIG. 4.

FIG. 3 is a view of an internal structure of a direct current relay according to an embodiment of the present disclosure, FIG. 4 is a perspective view of a mover assembly in FIG. 3, and FIG. 5 is an exploded perspective view of the mover assembly of FIG. 4. Hereinafter, a direct current relay according to each embodiment of the present disclosure will be described in detail with reference to the drawings.

The direct current relay according to an embodiment of the present disclosure, including a pair of fixed contacts 14 and a movable contact 50 which is moved up and down by an actuator 60 to come into contact with or be separated from the pair of fixed contacts 14, includes a mover support 40 disposed below the movable contact 50 and connected to the actuator 60 by a shaft 57, a mover holder 45 disposed above the movable contact 50 and fixed to the mover support 40, a contact pressure spring 55 disposed between the movable contact 50 and the mover support 40 to provide a contact pressure to the movable contact 50, and a supporting pin 35 installed to extend through the movable contact 50 and the mover holder 45.

A frame 11, 12 is defined as a box-shaped case to contain, protect, and support components therein. The frame 11, 12 may include an upper frame 11 and a lower frame 12.

An arc chamber 13 is defined in a box shape with an open lower surface, and is installed inside the upper frame 11. The arc chamber 13 is made of a material having excellent insulating property, pressure resistance, and heat resistance so as to extinguish an arc generated at the contact portion 14, 50 upon cutoffs. For example, the arc chamber 13 may be made of a ceramic material. The arc chamber 13 is fixedly installed above a middle plate 70.

The fixed contacts 14 are provided in a pair and fixedly installed on the arc chamber 13. The pair of fixed contacts 14 is exposed at the upper frame 11. One of the fixed contacts 14 may be connected to a power side, and another one of the fixed contacts 14 may be connected to a load side.

The movable contact 50 is defined as a plate-shaped body having a predetermined length, and is installed under the pair of fixed contacts 14. The movable contact 50 is installed in a mover assembly 30 to be moved integrally. Accordingly, the movable contact 50 moves linearly up and down by the actuator 60 installed inside the lower frame 12 to connect or disconnect a circuit by being brought into contact with or separated from the fixed contacts 14.

To effectively control the arc generated when the contact portion 14, 50 is cutoff (or separated), a permanent magnet (not illustrated) is provided. The permanent magnet is installed around the contact portion 14, 50 to generate a magnetic field to control the arc, which is a rapid flow of electricity. And, to fix the permanent magnet, a permanent magnet holder 15 is provided.

The actuator 60 is provided to move the mover assembly 30, in particular the movable contact 50. The actuator 60 may include a yoke 61 defined in a 'U' shape and forming a magnetic circuit, a coil 63 wound around a bobbin 62 installed inside the yoke 61 to generate a magnetic field by receiving an external power source, a fixed core 65 fixedly installed inside the coil 63 to generate a magnetic attraction force by being magnetized due to a magnetic field generated by the coil 63, a movable core 67 installed to be linearly movable under the fixed core 65 so as to be brought into contact with or separated from the fixed core 65 by the magnetic attraction force of the fixed core 65, a shaft 57 in which a lower end thereof is coupled to the movable core 67 and an upper end thereof is slidably inserted through the movable contact 50, a return spring 69 installed between the fixed core 65 and the movable core 67 so as to move the movable core 67 downwardly back to its original position, and a cylinder 68 to accommodate the fixed core 65, the movable core 67, and the return spring 69.

Between the actuator 60 and the arc chamber 13, there is provided the middle plate 70. The middle plate 70 is installed at an upper portion of the yoke 61 and made of a magnetic material to form a magnetic circuit together with the yoke 61. The middle plate 70 also serves as a support plate on which the arc chamber 13 at the upper portion and the actuator 60 at the lower portion may be installed, respectively. The cylinder 68 may be hermetically coupled to a bottom portion of the middle plate 70.

Between the middle plate 70 and the arc chamber 13, there may be provided a sealing member 72. The sealing member 72 is provided along a lower circumference of the arc chamber 13 to seal a space formed by the arc chamber 13, the middle plate 70 (a hole in a central portion of the middle plate), and the cylinder 68.

The mover assembly 30 includes the shaft 57, the mover support 40, the mover holder 45, the movable contact 50, the contact pressure spring 55, and the supporting pin 35.

The shaft 57 is implemented as a straight rod. A lower end of the shaft 57 is fixedly installed in the movable core 67. Accordingly, the shaft 57 moves up and down together with the movable core 67 according to a movement of the movable core 67 to thereby allow the movable contact 50 to be brought into contact with or separated from the fixed contact 14.

At an upper end portion of the shaft 57, a coupling portion 58 is formed. The coupling portion 58 may be defined in a plate shape, for example, a disk shape. The coupling portion 58 of the shaft 57 is fixedly coupled inside the mover support 40. The coupling portion 58 of the shaft 57 may be manufactured in, for example, an insert-molding manner in which the coupling portion 58 is coupled into the mover support 40.

The mover support 40 with the shaft 57 fixedly installed thereon is provided to support the movable contact 50 and the likes. The mover support 40 includes a first flat plate portion 41, and arm portions 42 protruding upwardly from opposite side ends of the first flat plate portion 41.

An upper surface of the first flat plate portion 41 of the mover support 40 is provided with a spring support portion 43 protruding therefrom.

The arm portion 42 of the mover support 40 is provided with an insertion groove 44, and the mover holder 45 is fixedly installed in the insertion groove 44.

When viewed from front (see FIGS. 3 to 5), a length (in a left-right direction) of the first flat plate portion 41 is shorter than a length (in the left-right direction) of the movable contact 50. Accordingly, contact tips of the movable contact 50 are exposed to opposite sides of the mover support 40, respectively.

A width (in a front-rear direction) of an inner surface (or the upper surface) of the first flat plate portion 41 may be greater than a width (in the front-rear direction) of the movable contact 50. Accordingly, the movable contact 50 can be stably moved up and down in the mover support 40.

To support the movable contact 50, the mover holder 45 is provided.

The mover holder 45 is fixedly installed on the mover support 40. The mover holder 45 is defined in a ' E' shape. That is, the mover holder 45 includes a second flat plate portion 46 and opposite side surface portions 47. The opposite side surface portions 47 extend downwardly from opposite side ends of the second flat plate portion 46.

A width (or a length in the left-right direction) of the second flat plate portion 46 may be smaller than the length of the movable contact 50. Accordingly, contact tips of the movable contact 50 are exposed to opposite sides of the mover holder 45, respectively.

A central portion of the second flat plate portion 46 is provided with a fitting hole 48 formed therethrough. The supporting pin 35 is fitted in the fitting hole 48. A diameter of the fitting hole 48 is smaller than a diameter of the supporting pin 35 in a state in which no external force is applied. Accordingly, when the supporting pin 35 is press-fitted to the fitting hole 48 of the mover holder 45, the supporting pin 35 is fixed to the mover holder 45.

The side surface portion 47 extends downwardly from the second flat plate portion 46. A width (or a length in the left-right direction) of the side surface portion 47 may be equal to the width of the second flat plate portion 46.

The side surface portion 47 may be provided with a plurality of holes 47*a*. Accordingly, a bonding force may increase in an insert-molding structure.

The movable contact 50 is installed to be brought into contact with a lower surface of the second flat plate portion 46. The movable contact 50 may not be fixed to the mover holder 45 and may be separable from the mover holder 45. Accordingly, when the mover assembly 30 moves upward, the movable contact 50 is separated from the second flat plate portion 46 so as to be brought into close contact with the fixed contact 14 by receiving a contact pressure from the contact pressure spring 55.

A lower surface of the movable contact 50 is provided with a mover support portion 51. Onto the mover support portion 51, an upper end portion of the contact pressure spring 55 is mounted. The mover support portion 51 also serves to support the supporting pin 35.

A central portion of the movable contact 50 is provided with a through hole 52. The through hole 52 is formed from an upper surface of the movable contact 50 to a lower surface of the mover support portion 51. Accordingly, the supporting pin 35 is inserted into the mover support 40 through the through hole 52.

A diameter of the through hole 52 is larger than a diameter of the fitting hole 48. In addition, the diameter of the through hole 52 is larger than a diameter of the supporting pin 35. Accordingly, the movable contact 50 may freely move up and down without being interfered with by the supporting pin 35.

The supporting pin 35 may be defined in a rolled plate shape. In other words, a cross section of the supporting pin 35 may be defined in a 'C' shape. Accordingly, the supporting pin 35 may contract in a direction in which a diameter of the supporting pin 35 is reduced by receiving a force from a circumferential surface of the supporting pin 35. In other words, the supporting pin 35 may serve as a leaf spring in a cross-sectional direction.

The supporting pin 35 is inserted into the fitting hole 48 of the mover holder 45 and the through hole 52 of the movable contact 50. Although a diameter of the supporting pin 35 is larger than the diameter of the fitting hole 48, the supporting pin 35 can be fitted in the fitting hole 48, since the supporting pin 35 contracts in a radial direction then stretches after being inserted in the fitting hole 48.

A lower end portion of the supporting pin 35 may be supported with being brought into contact with the first flat plate portion 41 of the mover support 40.

The upper end of the supporting pin 35 protrudes from a top portion of the mover holder 45. Accordingly, even if the mover assembly 30 moves up and down to cause an impact, the mover holder 45 or the movable contact 50 does not escape.

The contact pressure spring 55 is provided between the movable contact 50 and the mover support 40. The contact pressure spring 55 is provided to support the movable contact 50 and provide a contact pressure to the movable contact 50 when energized. The contact pressure spring 55 may be implemented as a compression coil spring.

The contact pressure spring 55 presses the movable contact 50 when energized, to prevent escape from the fixed contact 14.

Figure 6:
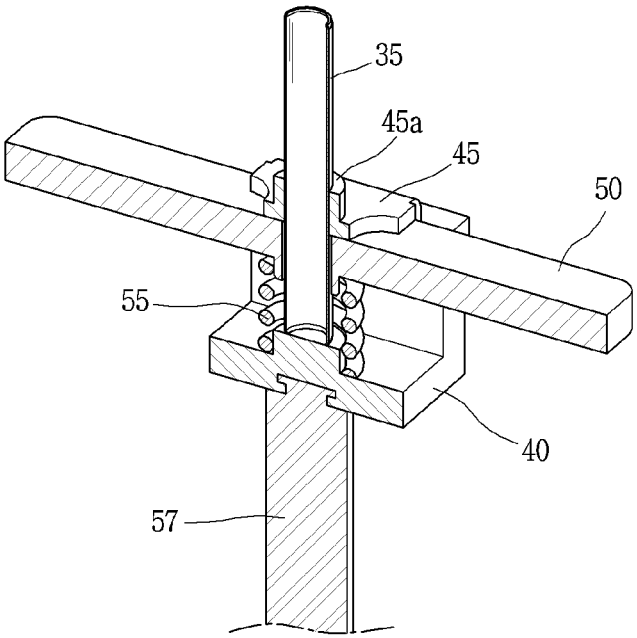
FIGS. 6 and 7 are sectional views of a mover assembly applied to a direct current relay according to other embodiments of the present disclosure.

Hereinafter, a mover assembly of a direct current relay according to another embodiment of the present disclosure will be described with reference to FIG. 6.

Components other than a mover holder 45 in the mover assembly of this embodiment may be same as or similar to those in the previous embodiment.

Unlike the previous embodiment, the mover holder 45 is provided with a support pipe portion 45*a*. And, as a length of the supporting pin 35 in contact with the mover holder 45 increases, an installation state of the supporting pin 35 may be more stably maintained.

Figure 7:
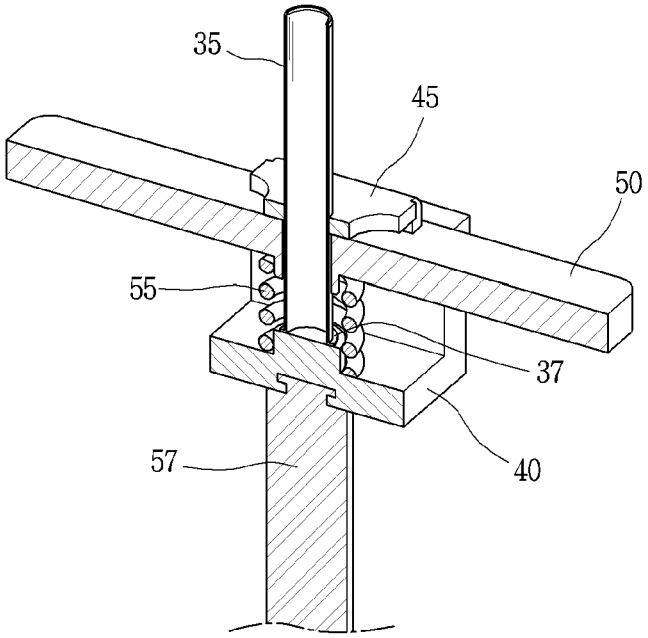

Hereinafter, a mover assembly of a direct current relay according to still another embodiment of the present disclosure will be described with reference to FIG. 7.

Components other than a supporting pin 35 in the mover assembly of this embodiment may be same as or similar to the first embodiment.

At a lower end portion of the supporting pin 35, there is provided a support ring portion 37 defined in a ring shape. The support ring portion 37 is preferably formed along an outer circumferential surface of the supporting pin 35. Since an area in which the supporting pin 35 is in contact with the first flat plate portion 41 is increased by the support ring portion 37, an installation state of the supporting pin 35 is more stably maintained.

According to the direct current relay according to an embodiment of the present disclosure, the supporting pin configured to support the movable contact and the mover holder by connecting the movable contact and the mover holder together is provided to prevent escape of the movable contact.

In addition, since the support pin is implemented as a spring plate and can simply be inserted into the mover holder and the movable contact, the support pin is easy to be assembled.

The foregoing embodiments are to implement embodiments of the present disclosure. Therefore, those skilled in the art to which the present disclosure pertains various modifications and variations will be possible without departing from the essential characteristics of the present disclosure. Therefore, the embodiments disclosed in the present disclosure are not intended to limit the technical idea of the present disclosure but to describe the present disclosure, and the scope of the technical idea of the present disclosure is not limited by these embodiments. The true scope of the present disclosure should be interpreted by the following claims, and all technical ideas within the equivalent scope should be interpreted as being included in the scope of the present disclosure.

The invention claimed is:

1. A direct current relay comprising a pair of fixed contacts and a movable contact which is moved up and down by an actuator to be brought into contact with or be separated from the pair of fixed contacts, comprising:

a mover support disposed below the movable contact and connected to the actuator by a shaft that is fixed to the mover support;

a mover holder disposed above the movable contact and fixed to the mover support;

a contact pressure spring disposed between the movable contact and the mover support to provide a contact pressure to the movable contact; and a supporting pin installed to extend through the movable contact and the mover holder, wherein:

an upper surface of the mover support is provided with a spring support portion protruding therefrom to support the contact pressure spring and the supporting pin, a central portion of the movable contact is provided with a fitting hole, a central portion of the mover holder is provided with a through hole through which the supporting pin is inserted, a diameter of the fitting hole is smaller than a diameter of the supporting pin in a state in which no external force is applied, a diameter of the through hole is larger than the diameter of the supporting pin, and the supporting pin is separated from the shaft by the mover holder and is concentrically aligned with the shaft.

2. The direct current relay of claim 1, wherein the supporting pin is implemented as a leaf spring.

3. The direct current relay of claim 1, wherein a cross section of the supporting pin is defined in a 'C' shape.

4. The direct current relay of claim 3, wherein the diameter of the fitting hole is larger than the diameter of the supporting pin in a state in which an external force is applied to a circumferential surface of the supporting pin to reduce the diameter of the supporting pin.

5. The direct current relay of claim 1, wherein a lower surface of the movable contact is provided with a mover support portion to support the supporting pin.

6. The direct current relay of claim 1, wherein the supporting pin protrudes outwardly of an upper portion of the mover holder.

7. The direct current relay of claim 1, wherein an upper surface of the mover holder is provided with a support pipe portion extending upwardly to support the supporting pin.

8. The direct current relay of claim 1, wherein at a lower end of the supporting pin, there is provided a support ring portion protruding in a ring shape along an outer circumferential surface of the supporting pin.

* * * * *